United States Patent [19]

Hudspeth et al.

[11] 4,117,426

[45] Sep. 26, 1978

[54] MULTIPLE CHANNEL ROTARY JOINT

[75] Inventors: Thomas Hudspeth, Malibu; Harold A. Rosen, Santa Monica, both of Calif.

[73] Assignee: Hughes Aircraft Company, Culver City, Calif.

[21] Appl. No.: 755,701

[22] Filed: Dec. 30, 1976

[51] Int. Cl.[2] ..... H01P 1/06; H01P 1/16; H01P 5/08

[52] U.S. Cl. ..... 333/98 TN; 333/11; 333/98 M

[58] Field of Search ..... 333/98 TN, 98 R, 97 R, 333/27, 21 A, 21 R, 83 R, 98 M, 1, 6, 7, 11

[56] References Cited

U.S. PATENT DOCUMENTS

| | | | |
|---|---|---|---|
| 2,595,186 | 4/1952 | Breetz | 333/98 TN X |
| 2,826,742 | 3/1958 | Hollis et al. | 333/985 X |
| 2,945,193 | 7/1960 | Strom | 333/98 TN X |
| 3,018,450 | 1/1962 | Hollis | 33/98 X |
| 3,189,855 | 6/1965 | Forrer | 333/1 X |

*Primary Examiner*—Alfred E. Smith
*Assistant Examiner*—Marvin Nussbaum
*Attorney, Agent, or Firm*—Rafael A. Cardenas; W. H. MacAllister

[57] ABSTRACT

A multiple channel microwave rotary joint is disclosed which is a toroidal cavity having first and second halves each with a bearing surface for rotation about the axis of the toroid. A plurality of input ports are mounted about the external cylindrical surface of the first half for generating a plurality of modes within the toroidal cavity. A first hybrid network is coupled to the inut ports for providing the proper phase input signals for generating the various modes. A second hybrid network is connected to a plurality of output probes mounted to the second half of the toroidal cavity. The rotary joint has a passageway which is axially aligned for allowing a plurality of multichannel rotary joints to be "stacked" and the interconnecting microwave cables or waveguides to pass through the passageways.

13 Claims, 8 Drawing Figures

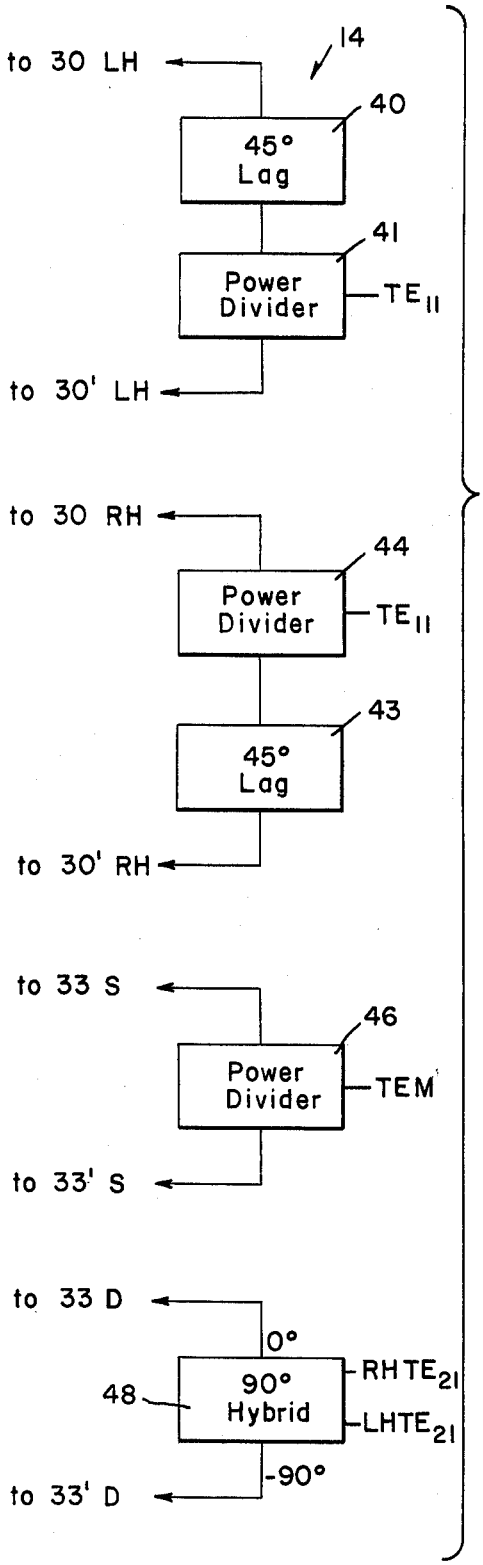
Fig. 4
Fig. 5a.
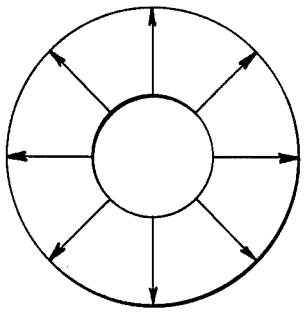
Fig. 5b.
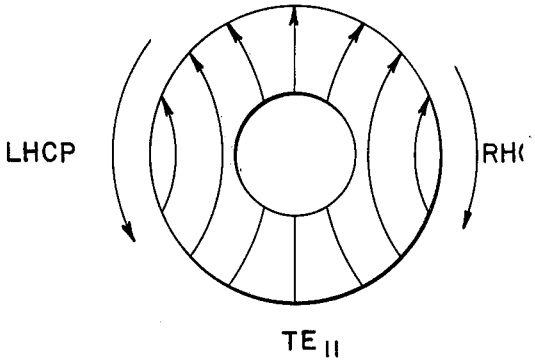
Fig. 5c.
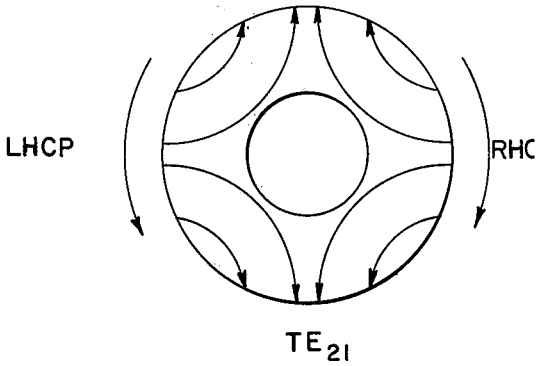

MULTIPLE CHANNEL ROTARY JOINT

FIELD OF THE INVENTION

The invention relates generally to microwave interconnecting devices and in particular the invention relates to a multichannel rotary joint for interconnecting microwave signals between a spinning body and a stationary one.

PRIOR ART

In a great variety of microwave systems the need often exists to efficiently couple energy between a stationary member and a rotating member. A typical example is the continuous scan antenna drive frequently employed in radar radio telescopy or communications systems. Since antennas continuously rotate a great number of turns, the energy cannot be directly coupled thereto by means of unitary cables or waveguides. Hence, a rotating joint which permits such complete rotation while satisfying all of the electrical and mechanical requirements of the system must be devised.

Numerous arrangements are presently known in the prior art. However, none of these heretofore known arrangements show the advantageous capabilities of the instant invention in meeting difficult combinations of performance requirements. Such requirements typically include: simultaneously coupling three or more signal channels without interference; handling high average and peak signal power in each channel; low signal attenuation; broad band operation while maintaining the properties of the translated signal; low voltage standing wave ratio (VSWR) and low variation in amplitude of the transmitted signal as the joint is rotated about its axis. It is also desired that a practical rotary joint be of a convenient size and construction permitting it to be incorporated about available axial structures such as a radar mast or torque tubes.

A particular application for rotary joints is found in spin stabilized spacecraft to connect spinning transmitters and receivers to their earth pointing despun antennas. Waveguide and coaxial transmission line designs have been used incorporating suitable choke joints at the rotational interface. The complexity of these systems goes up rapidly as the number of mutually isolated radio channels is increased. In coaxial systems, a concentric arrangement in which the outer conductor of one line serves as the inner conductor of the radially adjacent line permits several channels having adequate isolation to be achieved, but the ratio of outermost to innermost conductor diameters increases as $R^N$, where R is the diameter ratio of each line and N is the number of lines. This ratio becomes impractically large when the number of lines exceeds five or so.

OBJECTS AND SUMMARY

It is therefore an object of the present invention to provide a simple, reliable, and compact rotary joint for microwave application.

It is another object of the present invention to provide a microwave rotary joint which is capable of operating in a plurality of channels.

It is still another object of the present invention to provide a microwave rotary joint combination which is capable of handling a relatively large number of channels by stacking a plurality of rotary joints along mutual axis of rotation.

In accordance with the present invention and the foregoing objects, one embodiment of the multiple channel rotary joint includes a toroidal cavity having first and second portions rotatable relative to each other. A first plurality of input ports are coupled to the first portion of the toroidal cavity for receiving selected input signals for generating a plurality of modes within the toroidal cavity. Input means are coupled to the plurality of input ports for providing selected input signals. A plurality of output ports are coupled to the second portion of the rotary joint. In a second embodiment a plurality of multiple channel rotary joints according to the first embodiment are mounted together about their common axis of rotation. A first connecting structure connects the first portions of the plurality of multiple channel rotary joints while a second connecting structure connects the second portions of the plurality of rotary joints. The first and second connecting structures are in turn connected to first and second bodies, respectively, which may rotate with respect to each other. The passageways of the rotary joints provide interconnecting structure and waveguides.

BRIEF DESCRIPTION OF THE DRAWINGS

FIG. 4 is a schematic block diagram illustrating the input network for an eight port multiple channel rotary joint.

FIGS. 5*a*, 5*b*, and 5*c* are field flow diagrams illustrating the various modes generated by a multiple channel rotary joint having eight input ports.

DETAILED DESCRIPTION OF THE DRAWINGS

Figure 1:
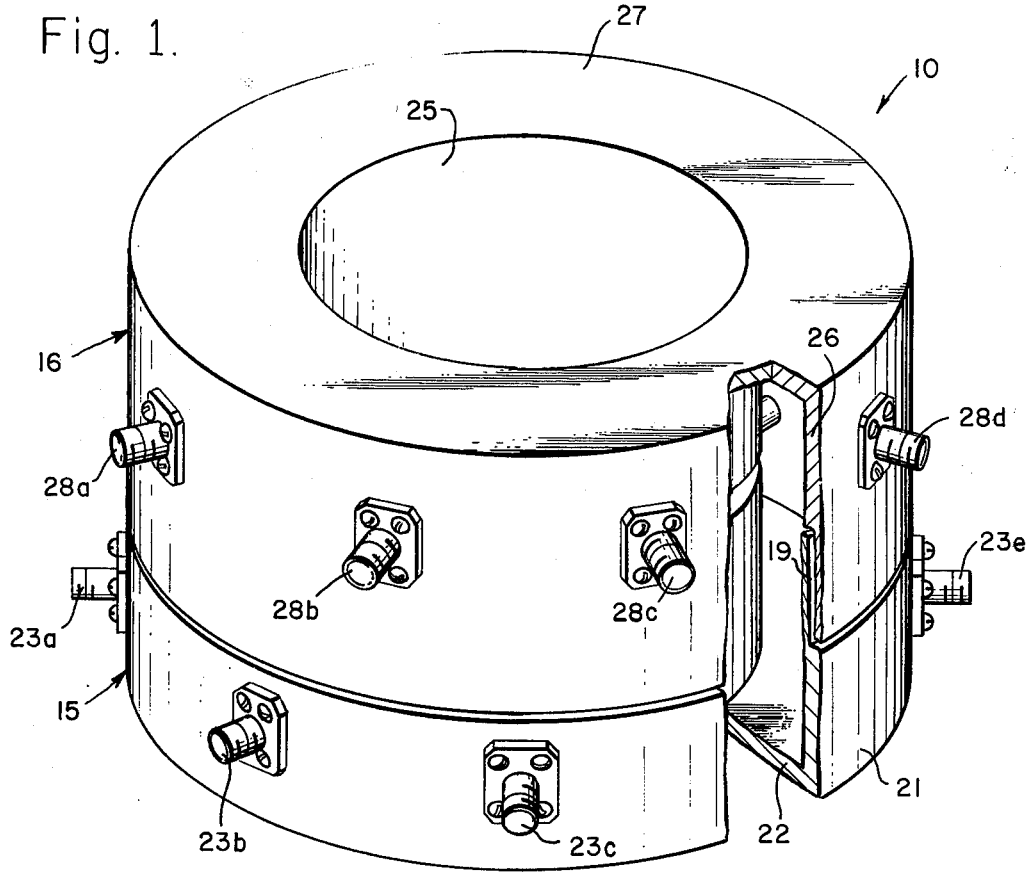
FIG. 1 is a perspective view diagram of a first embodiment of a multiple channel rotary joint according to the present invention.

Referring now more specifically to FIG. 1, a first embodiment of a multiple channel rotary joint includes a toroidal shaped cavity 10, an input network 12 (not shown) and an output network 13 (also not shown). The toroidal cavity 10 is comprised of lower and upper halves 15 and 16, respectively which rotate upon a bearing surface 17 that maintains the two rotating halves physically separated. Electrical continuity at microwave frequencies between the two halves 15 and 16 is established by quarter-wave shorted transmission lines 18 and 19. Transmission line 18 is a quarter-wave in length while the line 19 is a folded half-wave transmission line which is shorted at one end. A half-wave shorted transmission line may be utilized instead which would result in less RF leakage. The size of the cavity 10 is such that one type of mode propagates within the cavity, such as the TE modes, while another type of mode is attenuated, such as the TM modes, as will be explained further below.

The lower portion 15 of the rotary joint 10 is comprised of concentric inner and outer cylindrical walls 20 and 21 respectively and an annular bottom ring 22. A plurality of input ports such as coaxial connectors 23*a*–23*h* with attached probes are mounted to the outer surface of the outer cylindrical wall 21. The number of input ports 23 as well as size of the cavity 10 is determined by the number and type of modes to be propagated therein. Also, the ports 23 may be located on the inner wall 20 or the bottom ring 22 depending upon the modes being utilized. For example, if coaxially propagating modes, such as TE-type modes, are being propagated, the ports 23 may be located on the inner or outer walls 20 or 21. If the radially propagating modes, such as TM-type modes, are being propagated instead, the ports 23 are mounted on the bottom ring 22. The input ports may also be waveguide ports or loops for receiving the proper phase signals from the input network 12.

For a cavity utilizing TE-type modes, the spacing between adjacent input ports may range between ¼ and ½ wavelength. The spacing between the inner and outer cylindrical walls 20 and 21 is less than one-half wavelength so that the TM modes are attenuated. The height of the cavity 10 is approximately one wavelength or more to attenuate, or cut-off, modes which would otherwise cause amplitude modulation due to the rotation of one-half of the cavity with respect to the other half. The input and output ports 23 and 28 are spaced approximately one-half wavelength apart so that the higher order modes, which couple therebetween, thereby causing spin modulation, are also attenuated.

The upper half 16 of the toroidal cavity 10 is also composed of inner and outer cylindrical walls 25 and 26, respectively, and an annular top ring 27. A plurality of output ports such as coaxial connectors **28*a*–28*h* are mounted on the outer cylindrical wall 26. The number of connectors mounted to the upper half 16 is the same as the number of connectors in the lower half 15. The positioning of the connectors may be on the inner or outer cylindrical walls 24 and 25 or on the top ring 26 depending upon the modes being propagated similar to the lower half 15. The output ports may also be waveguide ports, loops or probes which are connected to the output network 13**.

Figure 2:
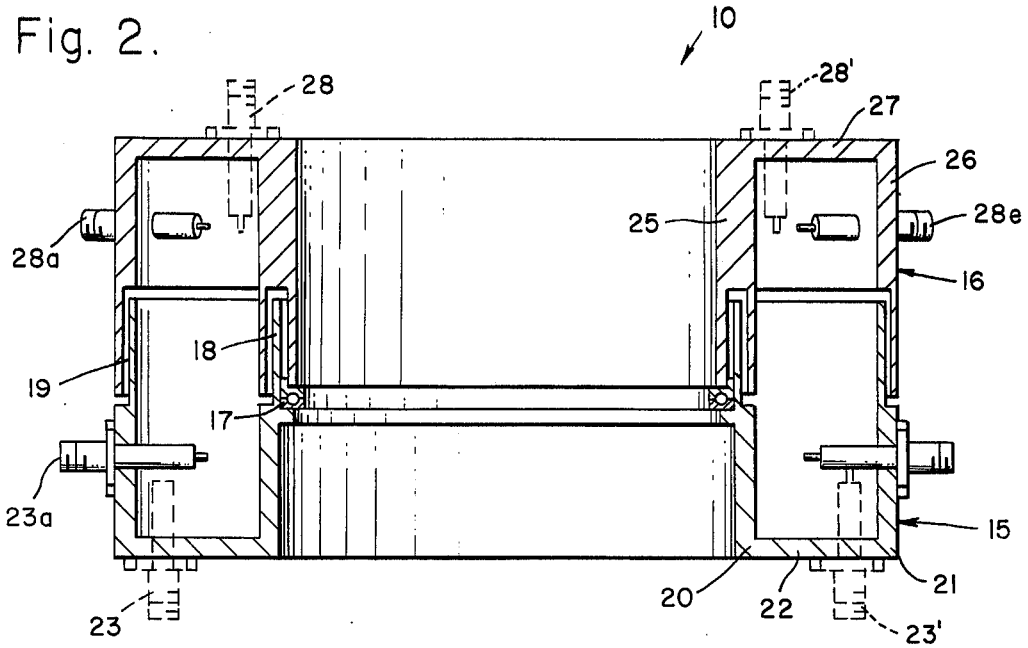
FIG. 2 is a cross-sectional view diagram of the invention according to FIG. 1.

Referring now to FIG. 2, the multiple channel rotary joint is now illustrated in greater detail in the cross-sectional view. The lower and upper halves, 15 and 16, of the toroidal cavity 10 rotate about each other along the bearing surface 17. The inner and outer shorted quarter-wave transmission lines 18 and 19 separate the two toroidal halves 15 and 16 along with the bearing surface 17. The dimensions of the cavity enclosed by the upper and lower halves 16 and 15, respectively, determine the waves which will propagate therein. For example, if TE modes are being propagated the input and output probes are oriented horizontally from either inner or outer walls so that E field lines are oriented in the horizontal direction and propagate parallel to the axis of rotation. The input and output probes 23 and 28, respectively, are separated by approximately one-half wavelength so that the modes causing spin modulation are attenuated. The height of the cavity 10 is approximately one wavelength or more to attenuate or cut-off modes which would otherwise cause amplitude modulation due to the rotation of one-half of the cavity with respect to the other half.

If TM waves are being propagated within the cavity 10, the input and output probes 23' and 28' are mounted vertically to the bottom and top rings 22 and 27, respectively. The input probes 23' are mounted at a first radial distance from the axis of rotation while the output ports 28 are mounted at one-half wavelength greater radius from the axis of rotation. Thus, the waves will propagate radially from the input ports 23 to the output ports 28. The width of the cavity should be approximately one wavelength or more and the height should be less than one-half wavelength so that the TM waves propagate and the TE waves are attenuated.

Figure 3:
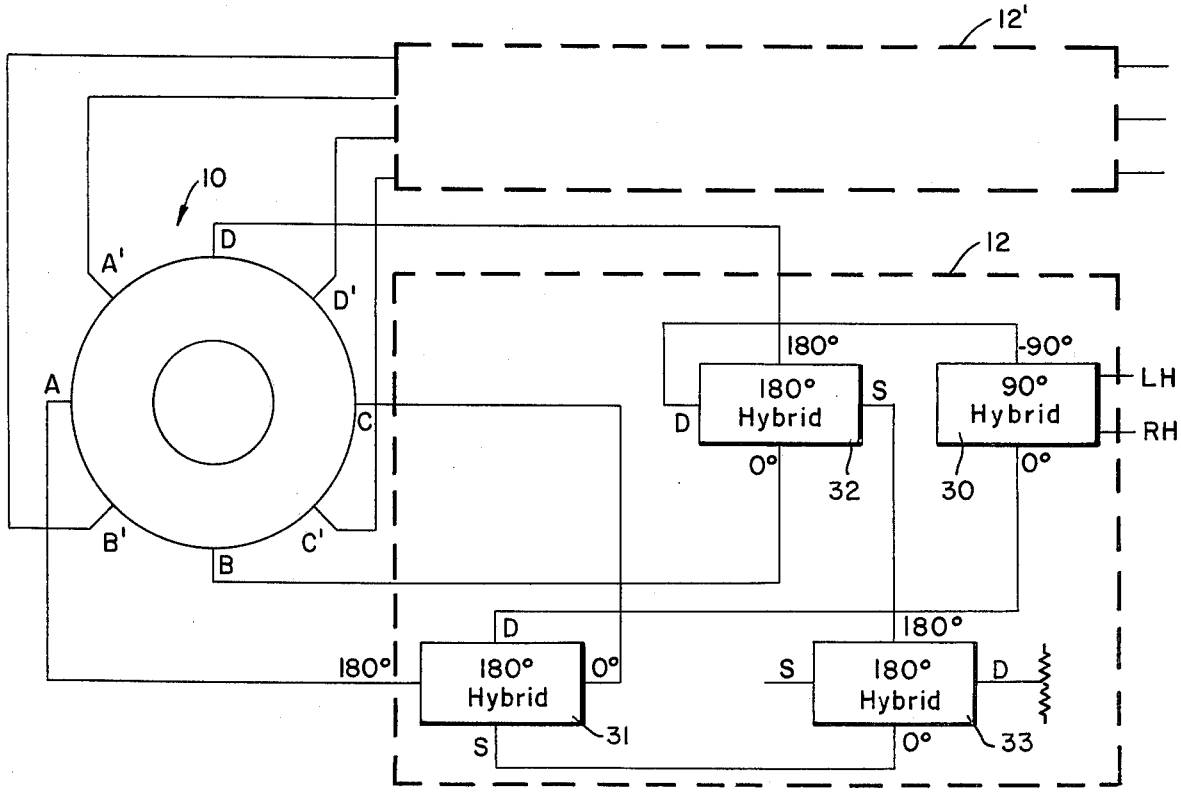
FIG. 3 is a schematic block diagram of a multiple channel rotary joint having four input ports according to FIG. 1.

FIG. 3 is a schematic block diagram illustrating the input section of both a four port and an eight port multiple channel rotary joint 10 and input networks 12 and 12'. Considering first the four port rotary joint, network 12 includes a 90° hybrid 30 having first and second input ports labeled RH and LH. A signal applied to the RH input terminal would generate a right-hand circular polarization mode within the rotary joint 10, while a signal applied to the LH terminal generates a left-hand circular polarization mode. The hybrid 30 has first and second output terminals labeled 0° and 90°, corresponding to the phase lag, in degrees, between the output ports and the RH input port. The hybrid 30 may be any suitable commercially available hybrid network for providing the required phase shift and an equal power division. The first output port of the hybrid 30 is connected to the "D" input port of a 180° hybrid 31.

The hybrid 31 has first and second input terminals labeled "S" and "D" for sum and difference, respectively, and first and second output terminals labeled 0° and 180°, which is the phase lag of the output signal with respect to the difference (D) input port. A signal applied to the sum (S) input port results in an output signal from the two output ports of 0° phase lag. The first output port (0°) of the hybrid 31 is connected to the "C" input port of the multiple channel rotary joint 10. The second output port (180°) of the hybrid 31 is connected to the "A" input terminal of the rotary joint 10. For a signal applied to the RH terminal of the hybrid 30, the hybrid 31 provides signals to the A and C terminals of the rotary joint 10 which are 180° out of phase. A signal applied to the RH input terminal of the hybrid 30 results in a signal at the D input terminal of the rotary joint 10 having a phase of 90° lag relative to probe A.

The second output terminal, labeled −90°, hybrid 30, is connected to the "D" input terminal of a second 180° hybrid 32, similar to the hybrid 31. The first output terminal of the hybrid 32, labeled 0, is connected to input terminal "B" of the rotary joint 10 and the second output port labeled 180° is connected to input port D of the joint 10. A signal applied to the RH input terminal of the hybrid 30 results in signals being applied to the terminals B and D which are 180° out of phase and B input terminal of the joint 10 leads the A input port by 90°. A signal applied to the LH input terminal of the hybrid 30 causes the hybrid 32 to provide signals that are 180° out of phase and input port B lags input port A by 90°. Thus $TE_{11}$ modes, both right and left hand circularly polarized, are generated as illustrated in FIG. **5*b***.

A third 180° hybrid 33, similar to the hybrid 31, has the "D" input terminal connected to a termination and the "S" input port receives an input signal. The first output port of the hybrid 33 is connected to the "S" input port of the hybrid 31. The second output terminal of the hybrid 33 is connected to the "S" input terminal of the second 180° hybrid 32. A signal applied to the S input terminal of the hybrid 33 results in the input ports of the rotary joint receiving signals which are in phase and thus a TEM mode is generated as seen in FIG. **5*a***.

An output network 13 (not shown) which is identical to the input network 12, is connected to the output ports 28 on the upper half 16 of the rotary joint 10. Since both the input and output networks are the same, the output network 13 will not be discussed in greater detail.

Referring briefly to FIGS. 3, 4 and 5, an eight port multiple channel rotary joint will now be described with reference to these three figures. It is noted that a second set of input terminals, labeled A', B', C' and D', are located on the rotary joint and displaced from the first set of input ports by 45°. By the application of the proper input signals five useful modes may be propagated within the rotary joint 10. Since the hybrid networks 12 and 12' are the same, the same reference numerals will be used to refer to corresponding components in both networks with the exception that the components of the network 11' will have primed reference numerals.

Referring more specifically to FIG. 4, a network 14 is utilized to interconnect the hybrid networks 12 and 12' for providing an 8 port rotary joint 10. A first 45° phase delay network 40 is connected between the LH input terminal of the hybrid network 30 and one output terminal of a power divider 41 which receives the input signal for generating the $TE_{11}$ modes. The second output terminal of the power divider 41 is connected to the LH input terminal of the hybrid 30' of the network 12'. The phase delay 40 may be a section of waveguide one-eighth wavelength long for providing the 45° phase lag. The power divider 41 may be any suitable device which is generally commercially available to equally divide the output power with equal phase. A signal applied to the input terminal of the power divider 41 causes left hand circularly polarized TE waves to be propagated within the rotary joint 10 as illustrated in FIG. 5*b*. A second 45° phase delay network 43 similar to the network 40, is connected between the RH input terminal of the hybrid network 30' of the network 12' and the first output terminal of a second power divider 44, similar to the divider 41. The second output terminal of the divider 44 is connected to the RH input terminal of the hybrid network 30. A signal applied to the input terminal of the power divider 44 results in the right hand circularly polarized $TE_{11}$ wave being propagated within the joint 10 as illustrated in FIG. 5*b*, also.

The first and second output terminals of a third power divider, similar to the divider 41, are connected to the "S" input terminals of 180° hybrid networks 33 and 33'. A signal applied to the input terminal of the power divider 46 causes the TEM mode to be propagated as seen in FIG. 5*a*.

The first output terminal labeled 0° of a 90° hybrid 47, similar to the hybrid 30, is connected to the "D" input terminal of the hybrid 33 instead of a load being connected as in the 4 port rotary joint. The second output terminal labeled −90°, is connected to the "D" input terminal of the hybrid 33'. A signal applied to the RH input terminal of the hybrid 47 causes a right hand circularly polarized $TE_{21}$ mode to be generated as seen in FIG. 5*c*. A signal applied to the LH input terminal generates a left hand circularly polarized $TE_{21}$ mode, also as seen in FIG. 5*c*.

An output network, which is identical to the input network 12, 12' and 14, is coupled to the output ports of an eight port multiple channel rotary joint and since the input and output networks are identical, the latter will not be described.

Figure 6:
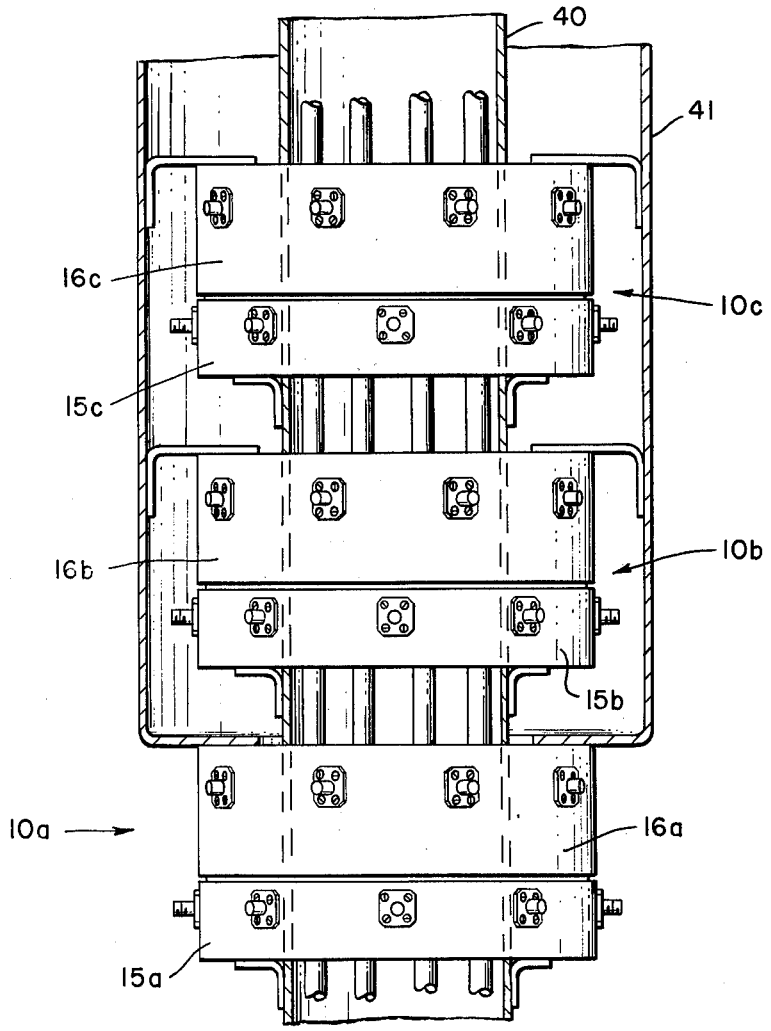
FIG. 6 is a diagram illustrating a side view of a multiple channel rotary joint according to a second embodiment of the present invention.

Referring now more specifically to FIG. 6, a plurality of multiple channel rotary joints 10, 10*a*, 10*b* and 10*c* are illustrated in one configuration in which the rotary joints may be "stacked" for providing an even greater channel capability. The rotating portions, 15*a*, 15*b* and 15*c*, of the several rotary joints 10*a*, 10*b* and 10*c*, respectively, are connected together through the interior aperture of the respective rotary joints so that they may rotate in unison by a cylindrical structure 40 having flanged members attached to the lower halves of the rotary joints. The stationary portions, 16*a*, 16*b* and 16*c*, of the several rotary joints 10*a*, 10*b* and 10*c*, respectively, are connected together by a second cylindrical structure 41 having flanged members attached to the stationary portions. The number of rotary joints that may be thus utilized is limited by only the space available for waveguides passing through the interior aperture of the rotary joints.

In summary, a multiple channel rotary joint is disclosed which is capable of providing five output modes which may be combined with other rotary joints for providing an even greater capacity.

Although the invention has been shown and described with reference to particular embodiments, nonetheless changes and modifications which may be made by one skilled in the art to which the invention pertains are deemed within the purview of the present invention.

What is claimed is:

1. A multiple channel rotary joint for transferring microwave energy from a stationary member to a rotating member, said microwave energy having a predetermined frequency and wavelength, comprising:

a toroidal cavity having first and second portions rotatable on each other for propagating a plurality of selected microwave modes, said toroidal cavity having an axial passageway, said cavity having predetermined dimensions for causing a TEM mode and two selected TE modes to propagate therein and for causing TM modes to be attenuated;

input means radially mounted to said first portion of said toroidal cavity and being in a first perpendicular plane to the axis of said toroidal cavity for propagating said modes therein; and output means radially mounted to said second portion of said toroidal cavity and being in a second perpendicular plane to the axis of said toroidal cavity for receiving said modes therein, said first and second planes being at least one-half wavelength apart.

2. The invention according to claim 1 wherein said input means comprise:

four microwave input ports being in a plane, each port being orthogonal to the preceding and succeeding input ports.

3. The invention according to claim 2 wherein said output means comprise:

four microwave output ports being in a plane, each port being orthogonal to the preceding and succeeding output port.

4. The invention according to claim 1 wherein said input means comprise:

first means for receiving first input signals having the same phase for propagating a TEM mode wave;

second means for receiving second input signals being in progressive phase quadrature for propagating a $TE_{11}$ mode wave having a first sense; and third means for receiving third input signals being in progressive phase quadrature for propagating a $TE_{11}$ mode wave having a second sense.

5. The invention according to claim 1 wherein said output means comprise:

first means for receiving a TEM mode wave and providing first output signals having the same phase;

second means for receiving a $TE_{11}$ mode wave having a first sense and providing second output signals being in progressive phase quadrature; and third means for receiving a $TE_{11}$ mode wave having a second sense and providing third output signals being in progressive phase quadrature.

6. A multiple channel rotary joint for transferring microwave energy from a stationary member to a rotating member, said microwave energy having a predetermined frequency and wavelength, comprising:

a toroidal cavity having first and second portions rotatable on each other for propagating a plurality of selected microwave modes, said toroidal cavity having an axial passageway, said cavity having predetermined dimensions for causing TM modes to propagate therein and for causing TE modes to be attenuated;

input means mounted parallel to a cylindrical plane having a first radius and being coaxial with the axis of said toroidal cavity for propagating TM modes therein; and output means mounted parallel to a cylindrical plane having a second radius and being coaxial with the axis of said toroidal cavity for receiving said TM modes therein, said first and second radii of different lengths by at least one-half wavelength.

7. A multiple channel rotary joint comprising:

a toroidal cavity having first and second portions rotatable on each other for propagating a plurality of selected microwave modes, said toroidal cavity having an axial passageway;

four microwave input ports coupled to said first portion of said toroidal cavity for propagating a selected plurality of at least three microwave modes;

first input signal means coupled to said input ports for generating a first mode by providing the same phase signal to each of said microwave input ports in response to a first signal;

second input signal means coupled to said microwave ports for generating second and third modes by providing 0°, 90°, 180°, and 270° phase signals to said microwave input ports having first and second senses in said toroidal cavity in response to second and third input signals, respectively; and output means coupled to said second portion of said toroidal cavity for conducting said microwave modes being propagated.

8. The invention according to claim 7 wherein said output means comprise:

four microwave output ports;

first output signal means coupled to said microwave output ports for receiving said first mode and providing a first output signal; and second output signal means for receiving said second and third modes and providing second and third output signals.

9. A multiple channel rotary joint comprising:

a toroidal cavity having first and second portions rotatable on each other for propagating a plurality of selected microwave modes, said toroidal cavity having an axial passageway;

four microwave ports mounted to said toroidal cavity for receiving input signals having preselected phases;

a first hybrid network having first and second input ports and first and second output ports, so that a signal applied to said first and second input ports causes first and second microwave modes, respectively, to propagate within said toroidal cavity;

a second hybrid network having first and second input ports and first and second output ports, said first input port being coupled to said first output port of said first hybrid network, said first and second output ports being coupled to said first and second microwave ports;

a third hybrid network having an input port and first and second output ports, said first output port being coupled to said second input port of said second hybrid network, so that a signal applied to said input port causes a third microwave mode to propagate within said toroidal cavity;

fourth hybrid network having first and second input ports and first and second output ports, said first input port being coupled to said second output port of said first hybrid network, said second input port being coupled to said second output port of said third hybrid network, said first and second output ports being coupled to said third and fourth microwave ports; and output means coupled to said second portion of said toroidal cavity for conducting said microwave modes being propagated.

10. A multiple channel rotary joint comprising:

a toroidal cavity having first and second portions rotatable on each other for propagating a plurality of selected microwave modes, said toroidal cavity having an axial passageway;

input means coupled to said first portion of said toroidal cavity for propagating a selected plurality of at least three microwave modes;

four microwave output ports mounted to said toroidal cavity for receiving selected microwave modes;

a first hybrid network having first and second input ports and first and second output ports, so that a signal applied to said first and second input ports causes first and second output signals corresponding to first and second microwave modes, respectively;

a second hybrid network having first and second input ports and first and second output ports, said first output port being coupled to said first input port of said first hybrid network, said first and second input ports being coupled to said first and second microwave ports;

a third hybrid network having an output port and first and second input ports, said first input port being coupled to said second output port of said second hybrid network, a third microwave mode causing an output signal at said output port of said third hybrid network; and a fourth hybrid network having first and second input ports and first and second output ports, said first output port being coupled to said second input port of said first hybrid network, said second output port being coupled to said second input port of said third hybrid network, said first and second input ports being coupled to said third and fourth microwave ports.

11. A multiple channel rotary joint for transferring microwave energy from a stationary member to a rotating member, said microwave energy having a predetermined frequency and wavelength, comprising:

a toroidal cavity having first and second portions rotatable on each other for propagating a plurality of selected microwave modes, said toroidal cavity having an axial passageway, said cavity having predetermined dimensions for causing a TEM mode and four selected TE modes to propagate therein and for causing TM modes to be attenuated.

input means radially mounted to said first portion of said toroidal cavity and being in a first perpendicular plane to the axis of said toroidal cavity for propagating said modes therein; and output means radially mounted to said second portion of said toroidal cavity and being in a second perpendicular plane to the axis of said toroidal cavity for receiving said modes therein, said first and second planes being at least one-half wavelength apart.

12. The invention according to claim 11 wherein said output means comprise:

eight microwave output ports;

first output means coupled to said microwave output ports for receiving said first mode and providing a first output signal;

second output means coupled to said microwave output ports for receiving said second and third modes and providing second and third output signals; and third output means coupled to said microwave output ports for receiving said fourth and fifth modes and providing fourth and fifth signals.

13. A multiple channel rotary joint comprising:

a toroidal cavity having first and second portions rotatable on each other, said toroidal cavity having a passageway axially located; said toroidal cavity for propagating a plurality of selected microwave modes;

eight microwave input ports coupled to a selected surface of said first portion of said toroidal cavity for propagating a selected plurality of at least five microwave modes;

first input signal means coupled to said microwave input ports for generating a first mode by providing the same phase signal to each of said microwave input ports in response to a first signal;

second input signal means coupled to said microwave input ports for generating second and third modes by providing an eight phase signal progressing by 45° to said microwave input ports, so that phase signals having first and second senses are produced in response to second and third signals respectively;

third input signal means coupled to said microwave input ports for generating fourth and fifth modes by providing an eight phase signal progressing by 90° to said microwave input ports, so that phase signals having first and second senses are produced in response to fourth and fifth signals, respectively; and output means coupled to a selected surface of said second portion of said toroidal cavity for conducting said microwave modes being propagated.

* * * * *